United States Patent [19]

James et al.

[11] 4,046,414

[45] Sept. 6, 1977

[54] APPARATUS FOR HOISTING A STRUCTURAL MEMBER

[76] Inventors: Arthur M. James, 2475 NW. 158th, Beaverton, Oreg. 97005; Charles J. Conlee, 6938 SW. 8th., Portland, Oreg. 97219

[21] Appl. No.: 682,220

[22] Filed: May 3, 1976

[51] Int. Cl.[2] ..... B66C 1/10

[52] U.S. Cl. ..... 294/81 R; 214/1 H; 294/67 R

[58] Field of Search ..... 294/67 R, 67 E, 67 DA, 294/67 DB, 81 R, 81 SF, 78 R, 78 A, 89; 52/122, 125, 126, 127, 745, 749; 212/11, 14, 41; 214/1 H

[56] References Cited

U.S. PATENT DOCUMENTS

| | | | |
|---|---|---|---|
| 2,063,040 | 12/1936 | Jolly | 294/78 R |
| 2,987,340 | 6/1961 | Mattera | 294/67 DB |
| 3,180,671 | 4/1965 | Bachmann | 294/81 R |
| 3,462,025 | 8/1969 | Toffolon | 294/81 R X |
| 3,613,925 | 10/1971 | Stum | 212/14 X |
| 3,647,254 | 3/1972 | Munson | 294/78 R |

FOREIGN PATENT DOCUMENTS

| | | | |
|---|---|---|---|
| 1,207,580 | 12/1965 | Germany | 294/81 R |
| 155,604 | 3/1963 | U.S.S.R. | 294/81 R |
| 194,287 | 1/1967 | U.S.S.R. | 214/1 H |

*Primary Examiner*—Johnny D. Cherry

*Attorney, Agent, or Firm*—Kolisch, Hartwell, Dickinson & Stuart

[57] ABSTRACT

Apparatus for hoisting a structural member including a load-distributing device with multiple strands depending therefrom secured to the structural member through hangers engaging A-frames in the structural member. The A-frames form truss structure imparting rigidity to the structural member, and have apexes adjacent the top surface of the structural member which the hangers engage.

4 Claims, 9 Drawing Figures

APPARATUS FOR HOISTING A STRUCTURAL MEMBER

This invention relates to hoisting apparatus, and more particularly to apparatus adapted to be connected to the hoist line of one or more cranes or similar instrumentalities adapting the crane for the lifting of an elongate structural member.

Structural members have been developed which comprise an elongate upper expanse or sheet of material spaced above and ordinarily substantially paralleling (but not always) an elongate lower expanse of material, and truss structure disposed between and interconnecting these upper and lower expanses of material and serving to impart rigidity to the structural member as a whole. This type of structural member has been used quite successfully in the building of a structure which must span two locations spaced a considerable distance apart, such as a roof structure intended to cover a large area. Such a structural member, comprising the upper and lower expanses (in certain structural members sometimes referred to as chords), and the truss structure interconnecting these chords (often times in the form of diagonals arranged to form multiple A-frames interposed between and interconnecting the chords), as a total unit has considerable strength well suited to withstanding the usual loads to be associated with the installation. However, the component parts of the structure, comprising the chords and the diagonals, by themselves are not extremely strong, and as a consequence problems are presented when it becomes necessary to transport a structural member of this description from one location to another. If done improperly, whereby one region of the structure is subjected to severe localized stressing, failure in such region occurs which can readily be followed by destruction of the whole unit.

Generally, therefore, it is an object of this invention to provide improved apparatus for the lifting and transporting of a structural member of the type described.

More particularly, an object is to provide apparatus of this description which includes a unique type of load-distributing device, and connections from this device to the member effective to enable lifting and moving of the structural member without the introduction thereinto of localized regions of over-stressing.

Yet another object of the invention is to provide lifting apparatus for structural members of this description, featuring connections with the truss structure of the structural member of a unique character, enabling the member to be lifted without introducing destructive, over-stressing in localized regions of the member.

These and other objects and advantages are attained by the invention, which is described hereinbelow in conjunction with the accompanying drawings, wherein.

Figure 6:
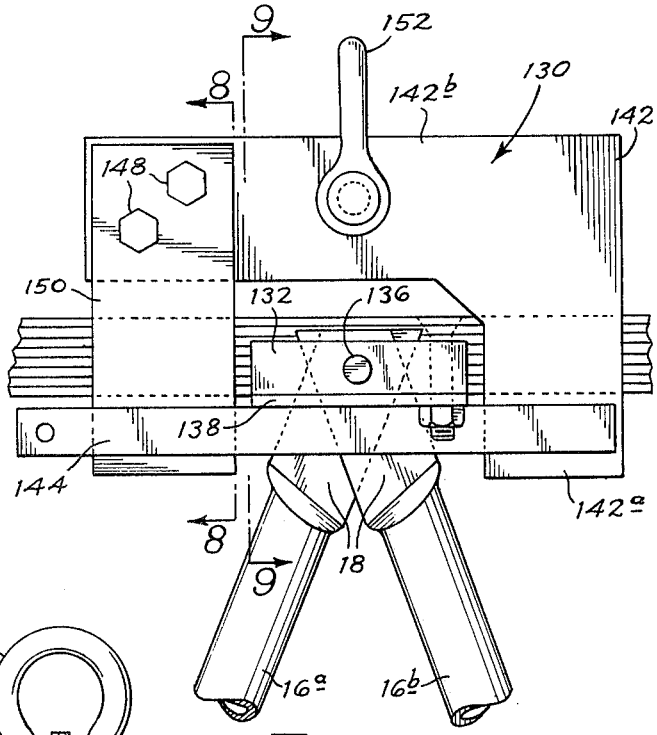
FIG. 6 is a view on an even larger scale, along the line 6—6 in FIG. 5, illustrating in greater detail means utilized in connecting a load-distributing device with the structural member through A-frame structure in the structural member.
Figure 8:
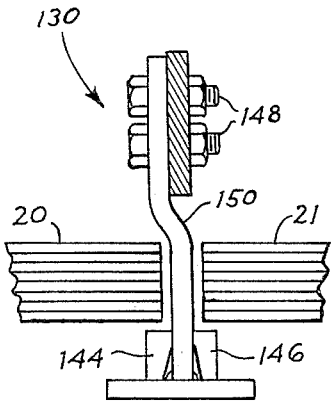
Figure 9:
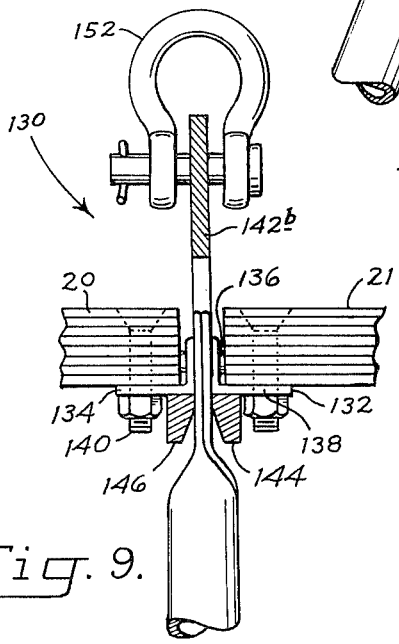

FIGS. 8 and 9 are cross-sectional views, taken generally along the lines 8—8 and 9—9 in FIG. 6.

Figure 1:
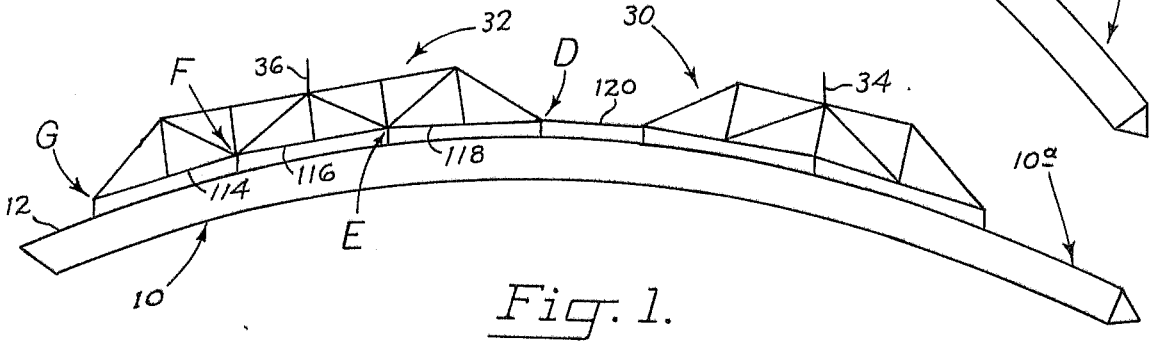
FIG. 1 is a simplified drawing illustrating diagramatically a structural member of the type that may expeditiously be handled utilizing the apparatus of the invention, and showing parts of hoisting apparatus attached to the structural member through load-distributing devices.

Referring now to the drawings, and more particularly to FIG. 1, indicated generally at 10 in a side view is an elongate structural member exemplary of the type that may be advantageously handled using the apparatus of the invention. Structural member 10 includes an upper elongate expanse or sheet of material 12, also referred to herein as upper chord, and spaced below it a lower elongate expanse or chord 14. Omitted from FIG. 1 but illustrated schematically in FIG. 3, are diagonals 16 extending between the upper and lower chords and forming truss structure imparting rigidity to the structural member as a whole.

Figure 2:
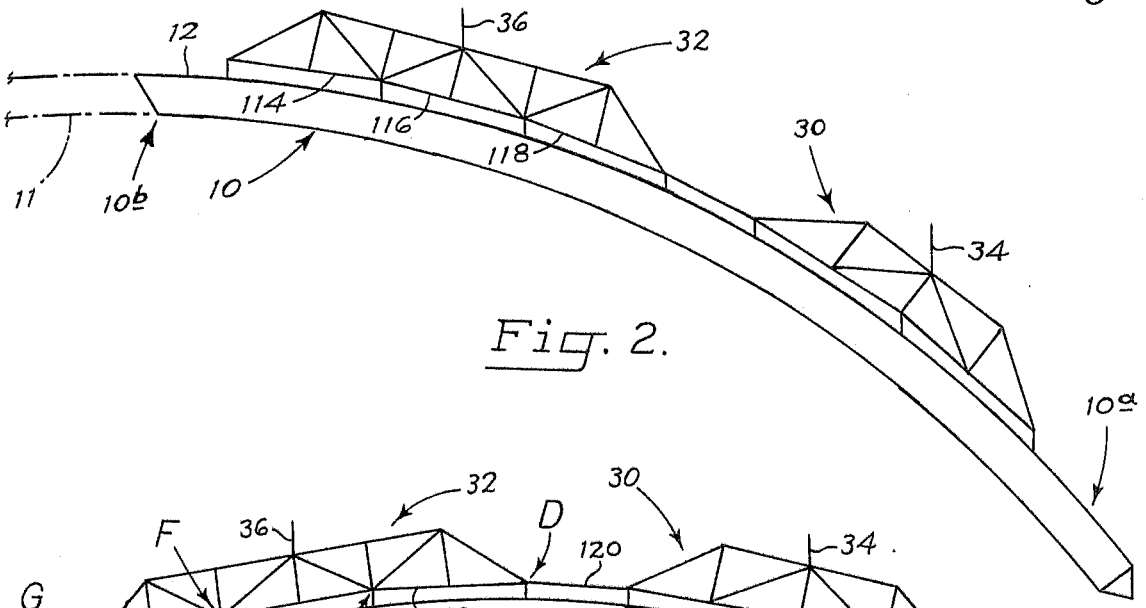
FIG. 2 illustrates the structural member and associated apparatus shown in FIG. 1, as such would appear with the member shifted by the hoisting apparatus to assume a different orientation.

The structural member 10 illustrated is an arch segment, and the upper and lower chords impart to the member an arcuately curved upper and lower profile. The arch segment exemplifies a structural component that might be utilized in covering a playing field. Thus, as shown in FIG. 2, the member may be oriented when installed with its end 10*a* anchored in place at one side of the field on a wall or post, and its opposite end 10*b* at an elevated position. Such a member may then be joined through end 10*b* to a similar arch segment, such as the one partially shown in dashed outline at 11 in FIG. 2, this latter segment having an end corresponding to end 10*a* anchored to a wall or post at the opposite side of the field. The two arch segments when united together form a complete span between the two side mountings. It should readily be seen that by installing a multiple number of such completed arches side-by-side along the length of a field, the arches collectively will form an arched roof of considerable span deriving support from means disposed along the sides of the field.

Figure 3:
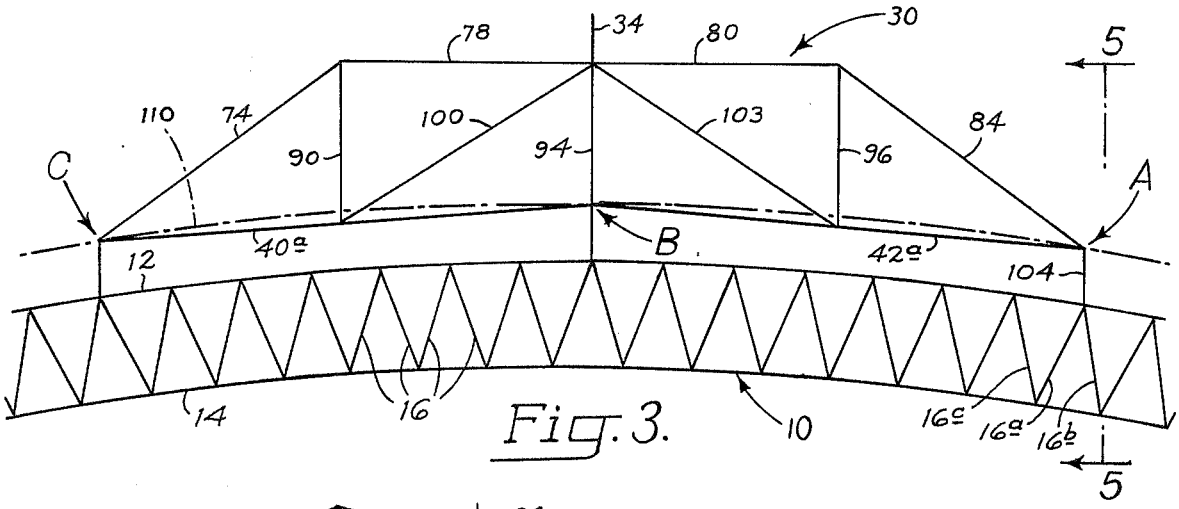
FIG. 3 is an enlarged view of portions of the structure illustrated in FIG. 1.

As can be seen in FIG. 3, diagonals 16 in arch segment 10 form in effect a series of A-frames interposed between the upper and lower chords. Thus, and considering diagonals 16*a* and 16*b* in FIG. 3, these have upper ends joined together and joined to upper chord 12. The diagonals diverge from each other progressing downwardly from their upper ends, and are connected at bottom ends to the lower chord and to upwardly diverging diagonals, as exemplified by diagonal 16*a* which is joined at its lower end to upwardly diverging diagonal 16*c*.

Figure 5:
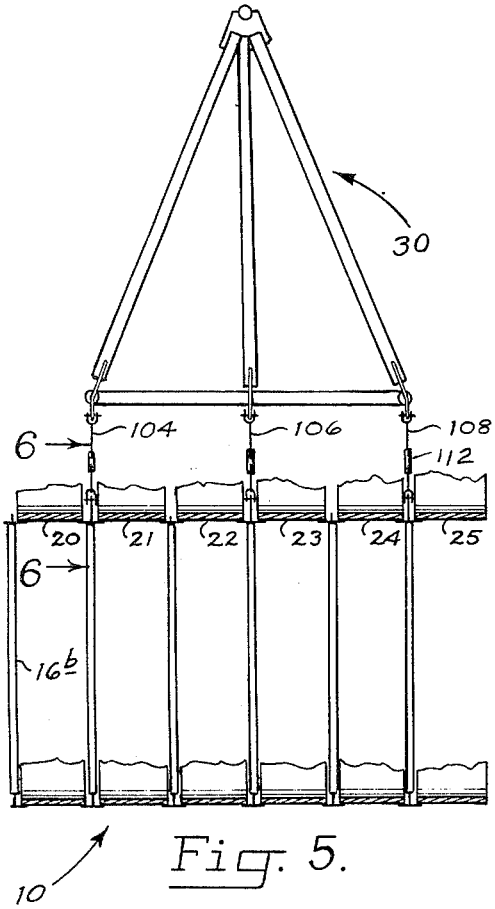
FIG. 5 is a view taken generally along the line 5—5 in FIG. 3, on a somewhat enlarged scale, illustrating further details of the load-distributing device and its attachment to the structural member.
Figure 7:
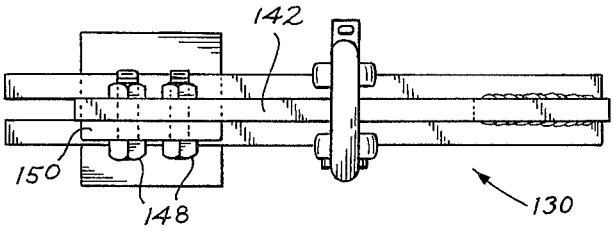
FIG. 7 is a top view of the connecting means illustrated in FIG. 6.

As perhaps best illustrated in FIGS. 5 and 6, each of the diagonals may take the form of an elongate metal pipe or tube with flattened ends, as exemplified by ends 18 indicated in FIG. 6, where a pair of diagonals are joined together. Chords 12 and 14 may be elongate expanses of plywood. Each expanse need not be continuous. In fact, in the arch segment shown, and considering chord 12 or the upper expanse of the arch segment, such comprises six elongate ribbons of plywood 20, 21, 22, 23, 24, 25 extending side-by-side along the length of the arch segment. These ribbons are joined to each other and to the diagonals by suitable means, as will be fully described.

It should be obvious that the arch segment described, by reason of its geometry and the internal truss structure which connects the chords therein, has considerable rigidity as an entire unit. The components of the arch segment, however, by themselves, are not of a rugged construction, and as a consequence when lifting such an arch segment, care must be taken that localized regions thereof are not overly stressed.

An embodiment of hoisting apparatus as contemplated is illustrated in FIGS. 1 and 2. Such includes a pair of load-distributing devices, indicated generally at 30 and 32. Each lifting device is adapted to be hoisted from the ground through a connection at approximately the center of the lifting device with the hoist line 34, 36 of a crane or other lifting instumentality.

Figure 4:
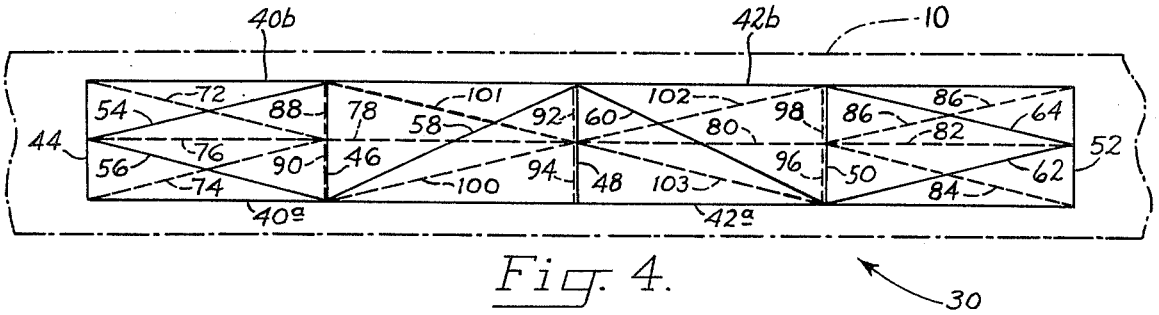
FIG. 4 is a plan view showing in solid lines the bottom chord of load-distributing device utilized in FIG. 3, and showing in dotted lines the top chord in the device.

Considering device 30, and referring to FIGS. 3 and 4, such takes the form of a rigid, space truss structure. The bottom chord of this structure is comprised of elongate bars 40*a,* 42*a* adjoined together at ends and forming one side of the base, and bars 40*b,* 42*b* joined together at ends and forming the opposite side. Spanning these bars and connected thereto are bars 44, 46, 48, 50 and 52. Making the rectangular framework of these bars rigid are diagonal bars or struts 54, 56, 58, 60, 62, and 64.

Forming the top chord of the space truss structure is an assemblage of bars (shown in dotted lines in FIG. 4) comprising bars 72, 74, 76, 78, 80, 82, 84, 86. Spanning the top and bottom chords are bars 88, 90, 92, 94, 96, 98, and bars 100, 101, 102, 103. These bars all suitably rigidly join together where they meet in the structure.

Load-distributing device 30 has depending from its right end in FIG. 3, or location A there indicated, and as best illustrated in FIG. 5, three depending wire ropes or strands 104, 106, 108. THese wire ropes or strands have upper extremities suitably joined to the load-distributing device and depend from the device at points located on opposite sides and at the center of the device, respectively. Referring to FIG. 3, a similar set of three strands depend from the device at location B, and yet another set of three strands depend from the device at location C, so that a total of nine strands extend downwardly from the distribution device to the arch segment or structural member below it. The wire ropes depend from the distribution device at locations of joinder in the space truss frame of the bars which make up the frame.

Arch segment or structural member 10 has a curved upper and lower profile as has already been explained. It will be noted, with reference to FIG. 3, that the bottom of load distribution device 30, as defined by the bottom chord in this device, presents at locations A, B and C points of connection with the depending wire ropes lying in a curved zone indicated at 110. This curved zone is spaced above and substantially parallels the upper curved profile of the arch segment as defined by expanse or upper chord 12. These strands in depending from the load distribution device to a connection with the arch segment below it, depend in reaches which are substantially parallel to each other.

As best illustrated in FIG. 5 each of the depending wire ropes is provided intermediate its ends with a take-up device or turnbuckle 112. Such provides for minor adjustments in the overall length in the rope, and is used, as hereinafter discussed, in obtaining a substantially equally tensed condition in all the wire ropes which depend from the device when the device is utilized to hoist the arch segment from the ground.

Load distribution device 32 is similar in construction to device 30 just described. As in the case of distribution device 30, device 32 is a space truss frame structure. In this case, the bottom chord of the device is made up of three bars along each side as exemplified by bars 114, 116, 118 shown in FIGS. 1 and 2. A suitable upper chord and interbracing structure is provided, to make the entire device rigid. In the case of device 32, a set of three wire ropes or strands depends from the device at four different locations, indicated in FIG. 1 at D, E, F and G, respectively. As in the case of distribution device 30, the points of connection of these wire ropes with the distribution device 30 lie in a curved zone which substantially parallels the upper curved profile of the arch segment, and the various wire strands are parallel to each other where they extend in reaches downwardly toward the arch segment below it.

As shown at FIG. 1, distribution device 30 is linked to distribution device 32. This linkage is effectuated by bar 120 connecting the adjacent ends of the device on the side of the assemblage facing the viewer in FIG. 1, and a similar bar connecting the two devices on the opposite side from the viewer. In this way, the relationship of the distribution devices with respect to each other during a lifting operation is maintained.

Each wire rope or strand depending from a distribution device is connected to the arch segment utilizing a hanger 130, illustrated in FIGS. 6–9, which interconnects the bottom end of the strand with the apex of an A-frame defined by diagonals 16 in the arch segment.

Referring now to FIGS. 6–9, and considering the diagonals 16*a,* 16*b* therein illustrated, these diagonals which are of metal tubular stock as already mentioned, have adjacent ends flattened where they are joined together. These flattened portions, as shown in FIGS. 6–9 have angle iron pieces 132, 134 placed along either side thereof, and these angle iron pieces and the flattened ends are united as with a rivet 136. The angle iron pieces, in their horizontal flanges 138, provide cleat portions extending out to either side of an A-frame formed by the diagonals. These cleat portions are utilized in the joinder of ribbons 20, 21 of the upper chord in the arch segment, utilizing fastener assemblies 140.

Hanger 130 includes an L-shaped bracket 142 including depending portion 142*a* and horizontal portion 142*b.* Joined to the base of depending portion 142*a* are a pair of parallel, spaced-apart arms 144, 146. Detachably connected to the distal end of horizontal portion 142*b,* as by fastener assemblies 148, is a plate 150. Clevis 152 is attached to horizontal portion 142*b* of the bracket, and a strand is connected to the bracket through this clevis.

In mounting the hangar on the ends of the diagonals which form an A-frame in this structure, plate 150 is removed. This enables bracket 142 to be moved upwardly into the space between ribbons 20, 21 so that the major part of bracket 142 becomes a projection which projects upwardly above the upper chord or expanse 12 in the arch segment. The hanger is moved laterally to move arms 144, 146 into a straddling relationship with respect to the joined upper ends of the diagonal 16*a,* 16*b,* with such arms additionally being underneath cleat portions 138. Plate 150 can then be mounted in place with such secured to the bracket 142 with fastener assemblies 148. When finally assembled, the hanger includes at its base structure straddling the apex of the A-frame and engaging the A-frame in a manner enabling the imparting of a lifting force thereto.

In utilizing the hoisting apparatus described, load-distributing devices 30, 32 are placed on top of an arch segment, and the wire ropes or strands which depend from the bottoms of these devices are connected to the A-frames in the structural member or arch segment utilizing the hangers described. All the wire ropes or strands have substantially the same length, by reason of the fact that their upper ends are attached to the load-distributing devices at points lying in a curved zone which substantially parallels the curvature of the upper profile of the arch segment, and by further reason of the fact that the wire strands parallel each other in depending downwardly from the load lifting devices. After connecting the bottom ends of the strands to the A-frames in the arched segment, the hoist lines 34, 36 are moved upwardly by the cranes of which they are a part, slightly to lift the arched segment from the ground on which it lies. At this time, final adjustments are made in the turnbuckles which are a part of each depending strand to insure that the tension in all the strands is substantially equal.

With further lifting of the arch segment through elevating of the hoist lines 34, 36, the arch segment may be moved to the location to where it is to be installed. At such location, the arch segment is oriented as shown in FIG. 2, with its end 10*a* adjacent the point where such is to be anchored to the pillar or wall at one side of the field, and end 10*b* elevated and in the position that it will have when connected to its complementing arch segment 11 in completing the arch. With tilting of the arch segment, and because the depending strands are all substantially of equal length and because of the parallel relationship maintained between the points of attachment with the load-distributing devices and the upper profile of the arch segment, there is minimal tendency to change the relationship of tensions established in the various strands, and to introduce localized regions of excessively high stress. The arch segment is, in effect, lifted through its truss structure by the connections established with the diagonals, as explained.

The apparatus has been used quite effectively in the handling of structural members of the type described. It is relatively easily secured to successive arch segments, as the same are installed one at a time in the building of a roof.

We claim:

1. In combination with a structural member, where said member includes an upper surface expanse and a lower surface expanse and truss A-frames interconnecting the expanses with the expanses spaced from each other and with the truss A-frames imparting rigidity to the structural member, said truss A-frames having apexes joined to and adjacent the upper surface expanse of the structural member, an elongate load-distributing device spaced above such structural member, and hoist means connected to the device operable to lift the device, multiple elongate strands connected to and depending from the base of the load-distributing device at points distributed along the length thereof, and means connecting a bottom end of a strand to said structural member including a hanger with structure straddling the apex of an A-frame and engaging the A-frame adjacent its apex in a manner enabling the imparting of a lifting force thereto.

2. The combination of claim 1, wherein a truss A-frame has cleats joined therewith projecting out to either side thereof adjacent its apex, and said hanger includes opposed, spaced-apart arms that straddle the apex of a truss A-frame and engage the cleats, said hanger having an upper portion projecting above said upper surface expanse.

3. In combination with a structural member which includes an upper surface expanse, a lower part, and truss A-frames interconnecting the upper surface expanse and lower part with apexes of said A-frames adjacent said upper surface expanse, hangers mounted on said A-frames engaging upper extremities thereof including upper portions projecting above said upper surface expanse, a device disposed above said structural member adapted to be connected to hoist means whereby to be lifted upwardly, and multiple elongate strands depending from said device and connected thereto with means connecting bottom ends of said strands to said upper portions of said hangers.

4. A combination of claim 3, wherein an A-frame includes adjacent its apex cleat portions joined thereto projecting out to opposite sides thereof, and a hanger includes opposed arms straddling the apex of an A-frame and underlying said cleat portions of an A-frame.

* * * * *